US008777185B2

(12) United States Patent
Ariyoshi et al.

(10) Patent No.: US 8,777,185 B2
(45) Date of Patent: Jul. 15, 2014

(54) ROTARY DEVICE AND WINCH PROVIDED WITH ROTARY DEVICE

(75) Inventors: Ryousuke Ariyoshi, Aichi (JP); Yukio Inaguma, Aichi (JP); Kenji Horiguchi, Aichi (JP); Hideki Kinoshita, Aichi (JP)

(73) Assignee: Toyota Shatai Kabushiki Kaisha, Aichi-ken (JP)

( * ) Notice: Subject to any disclaimer, the term of this patent is extended or adjusted under 35 U.S.C. 154(b) by 92 days.

(21) Appl. No.: 13/386,007

(22) PCT Filed: Jun. 7, 2010

(86) PCT No.: PCT/JP2010/059617

§ 371 (c)(1),
(2), (4) Date: Jan. 19, 2012

(87) PCT Pub. No.: WO2011/013443

PCT Pub. Date: Feb. 3, 2011

(65) Prior Publication Data

US 2012/0273739 A1 Nov. 1, 2012

(30) Foreign Application Priority Data

Jul. 27, 2009 (JP) ..... 2009-174124
Jul. 29, 2009 (JP) ..... 2009-176672

(51) Int. Cl.
*B66D 1/14* (2006.01)

(52) U.S. Cl.
USPC ..... 254/342; 254/323

(58) Field of Classification Search
USPC ..... 254/323–325, 342, 345; 414/462, 921; 224/310
See application file for complete search history.

(56) References Cited

U.S. PATENT DOCUMENTS

| | | | | |
|---|---|---|---|---|
| 5,651,573 | A | 7/1997 | Germain | |
| 6,612,265 | B1 * | 9/2003 | Birdsong | 119/856 |
| 7,334,972 | B2 * | 2/2008 | Cash | 410/98 |
| 2001/0052709 | A1 | 12/2001 | Fujikawa et al. | |
| 2006/0182569 | A1 * | 8/2006 | Andersson | 414/462 |
| 2008/0296268 | A1 * | 12/2008 | Mike et al. | 219/121.5 |

FOREIGN PATENT DOCUMENTS

| | | | |
|---|---|---|---|
| GB | 0900944 | * | 1/2009 |
| JP | 59-58205 | A | 4/1984 |
| JP | 60-114187 | | 8/1985 |
| JP | 3016800 | U | 10/1995 |
| JP | 10-77192 | A | 3/1998 |
| JP | 11-228069 | A | 8/1999 |
| JP | 2000-53381 | A | 2/2000 |
| JP | 2002-3146 | A | 1/2002 |
| JP | 2006-501100 | A | 1/2006 |
| JP | 2009-78679 | A | 4/2009 |

* cited by examiner

*Primary Examiner* — Emmanuel M Marcelo
*Assistant Examiner* — Angela Caligiuri
(74) *Attorney, Agent, or Firm* — Christensen Fonder P.A.

(57) ABSTRACT

A bracket of a rotation device of the present invention has a guide mechanism that is configured to guide a first motor and a second motor so as to rotate the same about an axis of a cylindrical rotating body relative to each other. A first gear and a second gear can respectively be meshed with rotating body side gears corresponding thereto while the first motor or the second motor is deviated around the axis of the cylindrical rotating body from a normal attachment position with respect to the bracket. Further, the first motor or the second motor can be guided to the normal attachment position by the guide mechanism in the condition.

7 Claims, 14 Drawing Sheets

FIG. 13 (A)
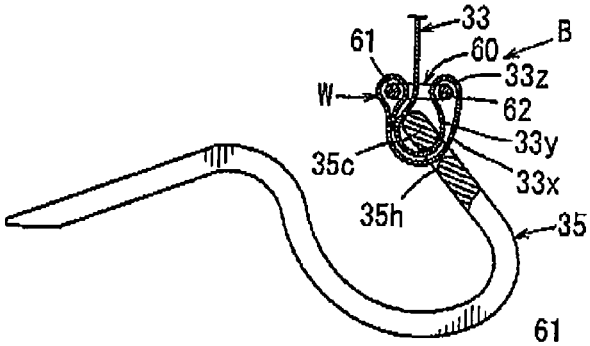
FIG. 13 (B)
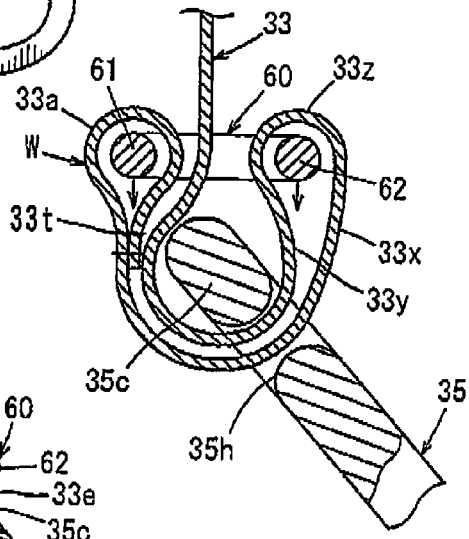
FIG. 13 (C)
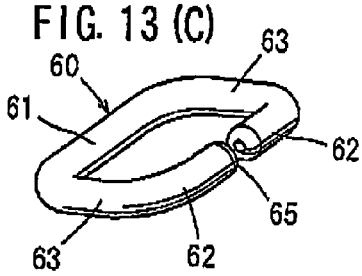
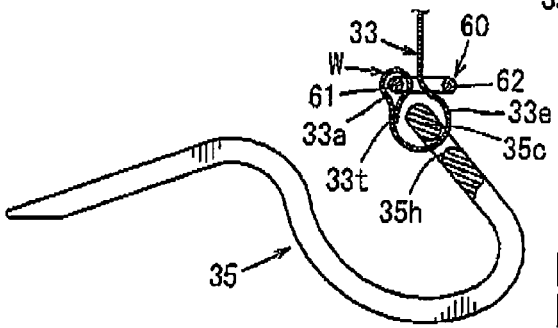
FIG. 13 (D)
PRIOR ART
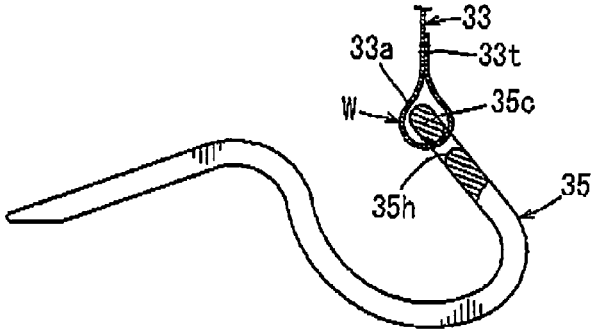
FIG. 13 (E)
PRIOR ART

ROTARY DEVICE AND WINCH PROVIDED WITH ROTARY DEVICE

PRIORITY CLAIM

The present application is a National Phase entry of PCT Application No. PCT/JP2010/059617, filed Jun. 7, 2010, which claims priority from Japanese Patent Application Number 2009-174124 filed Jul. 27, 2009 and Japanese Patent Application Number 2009-176672, filed Jul. 29, 2009, the disclosures of which are hereby incorporated by reference herein in their entirety.

TECHNICAL FIELD

The present invention relates to a rotation device having a cylindrical rotating body capable of rotating about an axis in which the cylindrical rotating body is configured to be driven by a plurality of motors and a gear mechanism, and a wind-up device having the rotation device.

BACKGROUND ART

A related conventional rotation device is disclosed in Japanese Laid-Open Utility Model Publication No. 2000-53381 (Japanese Patent No. 3338952).

The rotation device disclosed in Japanese Laid-Open Utility Model Publication No. 2000-53381 a winch, which has a main drum and a sub drum that are positioned coaxially. The main drum is connected to a main hydraulic motor via a main gear mechanism. Conversely, the sub drum is connected to a sub hydraulic motor via a sub gear mechanism. That is, each of the drums can be driven by a motor and a gear mechanism.

To the contrary, in order to downsize a mechanism for driving the drum, a drum may be driven by using two small motors and two sets of gear mechanisms (dram-side gears and motor-side gears). In this case, upon actuation of the two motors in synchrony with each other, similar to the case in which a single motor is used, the drum can be rotated in a winding direction or an unwinding direction. The drum, the gear mechanisms and the motors are attached to predetermined positions of a bracket (not shown).

SUMMARY OF THE INVENTION

Problems to be Solved by the Invention

However, in the device described above, when the motors are attached to the bracket, teeth (tooth grooves) of the dram-side gears and tooth grooves (teeth) of the motor-side gears positioned above and below must be simultaneously meshed with each other. For example, in a condition in which one (upper) motor-side gear and the dram-side gear are meshed with each other and in which the motor is fixed to the bracket, if the teeth (tooth grooves) of the other (lower) motor-side gear and the tooth grooves (teeth) of the dram-side gear are not aligned with each other, the two gears cannot be meshed with each other. As a result, the motor cannot be fixed to the bracket.

Thus, when the motors are attached to the bracket, the dram-side gears and the motor-side gears positioned both sides (above and below) of the drum must be meshed with each other. Therefore, an attaching operation is difficult to perform.

Thus, there is a need in the art to provide an improved rotation device.

SUMMARY OF THE INVENTION

A first aspect of the present invention provides a rotation device which includes a cylindrical rotating body that is configured to be rotatable about an axis, a bracket rotatably supporting the cylindrical rotating body, a plurality of motors attached to the bracket, rotating body side gears that are coaxially secured to the cylindrical rotating body, a first gear connected to the first motor and meshed with the rotating body side gear corresponding thereto, and a second gear connected to the second motor and meshed with the rotating body side gear corresponding thereto. The bracket has a guide mechanism that is configured to guide the first motor and the second motor so as to rotate the same about an axis of the cylindrical rotating body relative to each other. The first gear and the second gear can respectively be meshed with the rotating body side gears corresponding thereto while the first motor or the second motor is deviated around the axis of the cylindrical rotating body from a normal attachment position with respect to the bracket. Further, the first motor or the second motor can be guided to the normal attachment position by the guide mechanism in the condition.

According to the present invention, the bracket has the guide mechanism that is configured to guide the first motor and the second motor so as to rotate the same about the axis of the cylindrical rotating body relative to each other. Therefore, in a condition in which the second motor is attached to the normal attachment position and in which the second gear and the rotating body side gear are meshed with each other, the first motor can be gradually moved (rotated) around the axis of the cylindrical rotating body with respect to the second motor and the rotating body side gears, so as to align teeth (tooth grooves) of the first gear with tooth grooves (teeth) of the rotating body side gear.

Further, after the first gear and the second gear are completely meshed with the rotating body side gears, the first motor can be moved to the normal attachment position around the cylindrical rotating body using the guide mechanism.

Thus, a meshing operation of the first gear and the rotating body side gear connected to the first motor and a meshing operation of the second gear and the rotating body side gear connected to the second motor can be easily performed, so that efficiency of an attaching operation of the motors to the cylindrical rotating body can be increased.

In the second aspect of the present invention, the bracket is composed of a first bracket supporting one axial end of the cylindrical rotating body and a second bracket supporting the other axial end of the cylindrical rotating body. The first motor and the first gear are attached to the first bracket. The second motor and the second gear are attached to the second bracket. The guide mechanism is positioned between the first bracket and the second bracket.

Thus, the bracket is composed of the first bracket supporting one axial end of the cylindrical rotating body and the second bracket supporting the other axial end of the cylindrical rotating body. Therefore, the attachment of the cylindrical rotating body to the bracket can be easily performed. Further, the first motor and the first gear are attached to the first bracket. Conversely, the second motor and the second gear are attached to the second bracket. Therefore, the meshing operations of the first gear and the second gear and the rotating body side gears can be easily performed.

In the third aspect of the present invention, the rotating body side gears are respectively attached to one axial end side and the other axial end side of the cylindrical rotating body. The rotating body side gear attached to one axial end side of the cylindrical rotating body is meshed with the first gear.

Further, the rotating body side gear attached to the other axial end side of the cylindrical rotating body is meshed with the second gear.

That is, a rotational force can be applied to both sides in an axial direction of the cylindrical rotating body, so that the cylindrical rotating body can be rotated in a well-balanced manner.

In the fourth aspect of the present invention, the guide mechanism has a pin, and an arcuate elongated hole that is capable of guiding the pin.

Therefore, a construction of the guide mechanism can be simplified.

A fifth aspect of the present invention provides a wind-up device having a rotation device of the first aspect of the present invention as a wind-up drive source, in which a hook connected to a suspension belt is hooked on a hook receiving belt provided along a seating surface of a wheelchair and in which the wheelchair can be lifted up by winding up the suspension belt. The hook has a belt hole through which the suspension belt is passed and has a support to which the suspension belt is attached being provided on the upper side of the belt hole, which support is positioned above the belt hole. The suspension belt is attached to a drum capable of winding or unwinding the suspension belt. A distal end portion of the suspension belt is secured to one side of a ring-shaped snap ring. A halfway portion of the suspension belt is engaged with the other side of the snap ring from an outside, which side is positioned opposite to one side portion across a center. A portion of the suspension belt extending from one side portion to the other side portion of the snap ring and a portion of the suspension belt positioned between the other side portion of the snap ring and the drum are passed through the belt hole of the hook in a two-ply condition, and are engaged with the support of the hook.

Thus, because the hook and the suspension belt are connected to each other via the snap ring, the suspension belt can be easily disengaged from the hook as compared with a construction in which the hook and the suspension belt are directly connected to each other.

Further, because a two-ply portion of the suspension belt can be engaged with the support of the hook, once a tensile force is applied to the suspension belt 33 to tighten the suspension belt 33 positioned between the hook and the snap ring, the suspension belt 33 cannot be easily loosened even when the tensile force is released. That is, the hook and the snap ring are bound by the suspension belt. Thus, the snap ring can be prevented from hitting the hook each time the suspension belt is wound up. As a result, generation of noise can be suppressed. Further, the hook and other components can be prevented form being damaged with time.

Further, when the tensile force is applied to the suspension belt, both of one side and the other side of the snap ring are pulled toward the support of the hook by a uniform force. As a result, the snap ring is attached to the hook in a substantially horizontal posture. Thus, when the hook is wound up to an upper limit position, so that the snap ring contacts a hook stopper, one side and the other side of the snap ring can contact the hook stopper at the substantially same moment. Thus, the hook can be prevented from precariously swinging.

In the sixth aspect of the present invention, a circumferential portion of the snap ring is cut off to form a gap therein. The suspension belt can be guided to an inside of the snap ring from an outside of the snap ring using the gap.

Thus, it is possible to doubly fold back a portion of the suspension belt in the vicinity of the distal end portion thereof in a condition in which a distal end portion of the suspension belt is secured to one side of the snap ring, to pass a two-ply portion through the belt hole of the hook, and then to engage a fold-back end of the two-ply portion with the other side of the snap ring via the gap of the snap ring.

In the seventh aspect of the present invention, a cover member covering the snap ring is included.

Therefore, the snap ring can be prevented from being damaged by contacting the hook stopper at an upper limit position.

According to the present invention, in a rotation device in which a cylindrical rotating body is configured to be driven by a plurality of motors, a meshing operation of a first motor-side gear and a rotating body-side gear and a meshing operation of a second motor-side gear and a rotating body-side gear can be easily performed. Therefore, it is possible to increase efficiency of an attaching operation of the motors to the rotating body.

BRIEF DESCRIPTION OF THE DRAWINGS

FIG. 13(A) is a side view a hook, a snap ring and a suspension belt of a wind-up device according to Embodiment 3 of the present invention, illustrating a relation thereamong;

FIG. 13(B) is an enlarged view of a portion B of FIG. 13(A);

FIG. 13(C) is a perspective view of the snap ring;

FIG. 13(D) is a side view illustrating a conventional relation between the hook and the suspension belt;

FIG. 13(E) is a side view illustrating a conventional relation between the hook and the suspension belt;

DETAILED DESCRIPTION OF THE INVENTION

Embodiment 1

Figure 1:
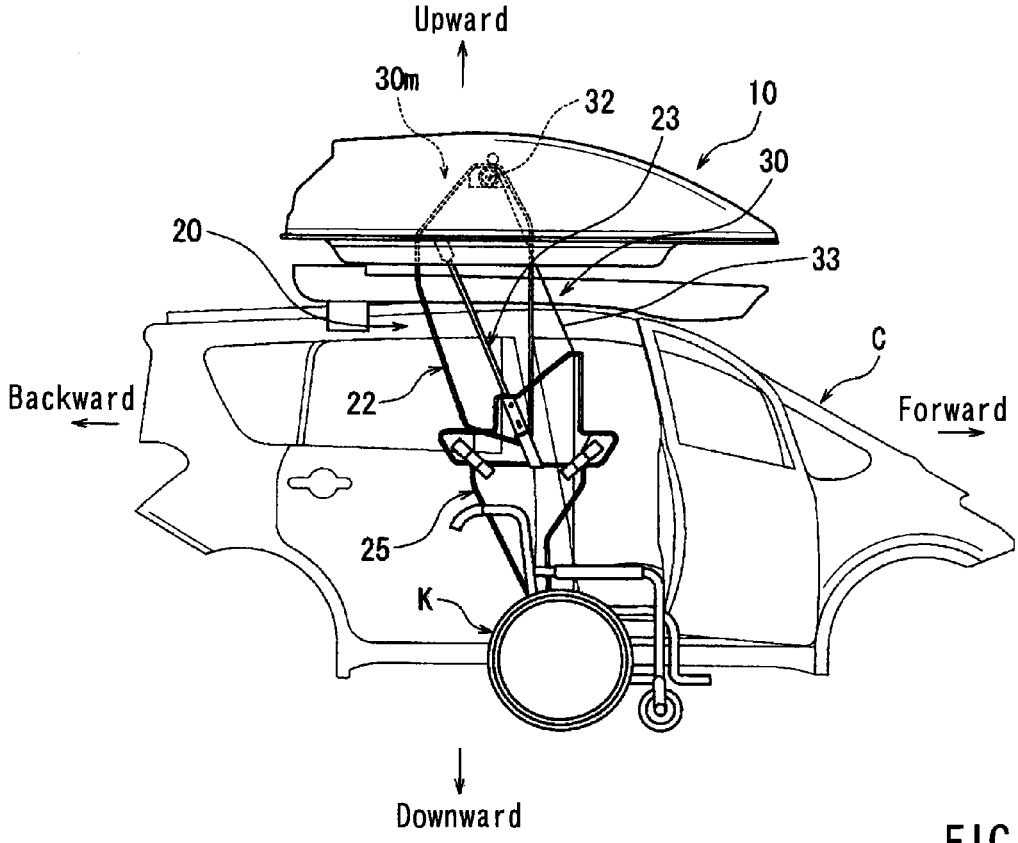
FIG. 1 is a side view of a vehicle wheelchair storing device having a rotation device according to Embodiment 1 of the present invention.

In the following, a rotation device according to Embodiment 1 of the present invention will be described with reference to FIGS. 1 to 8. The rotation device 30*m* according to the present embodiment is a drive portion of a wind-up device 30, and is used in a vehicle wheelchair storing device 10 shown in FIG. 1.

<Outline of the Vehicle Wheelchair Storing Device 10>

The vehicle wheelchair storing device 10 is a device for lifting up a wheelchair K and storing the same on a roof of an automobile C after a driver has moved from the wheelchair K to a driver's seat of the automobile C. The vehicle wheelchair storing device 10 has a wheelchair support portion 20 that is configured to be vertically rotatable between a raised position shown in FIG. 1 and a horizontal position (not shown), and an device main body portion (not shown) that is configured to laterally slide the wheelchair support portion 20 in the horizontal position to a storing position on the roof.

The wheelchair support portion 20 is composed of a carrier 22 that is vertically rotatably connected to the device main body portion, a protector 25 that is capable of restraining the wheelchair K folded up in the course of being lifted up in a predetermined position, a guide mechanism 23 that vertically slidably connects the protector 25 to the carrier 22, and the wind-up device 30 that is capable of lifting up the wheelchair K and the protector 25 with respect to the carrier 22.

<Outline of the Wind-Up Device 30>

Figure 2:
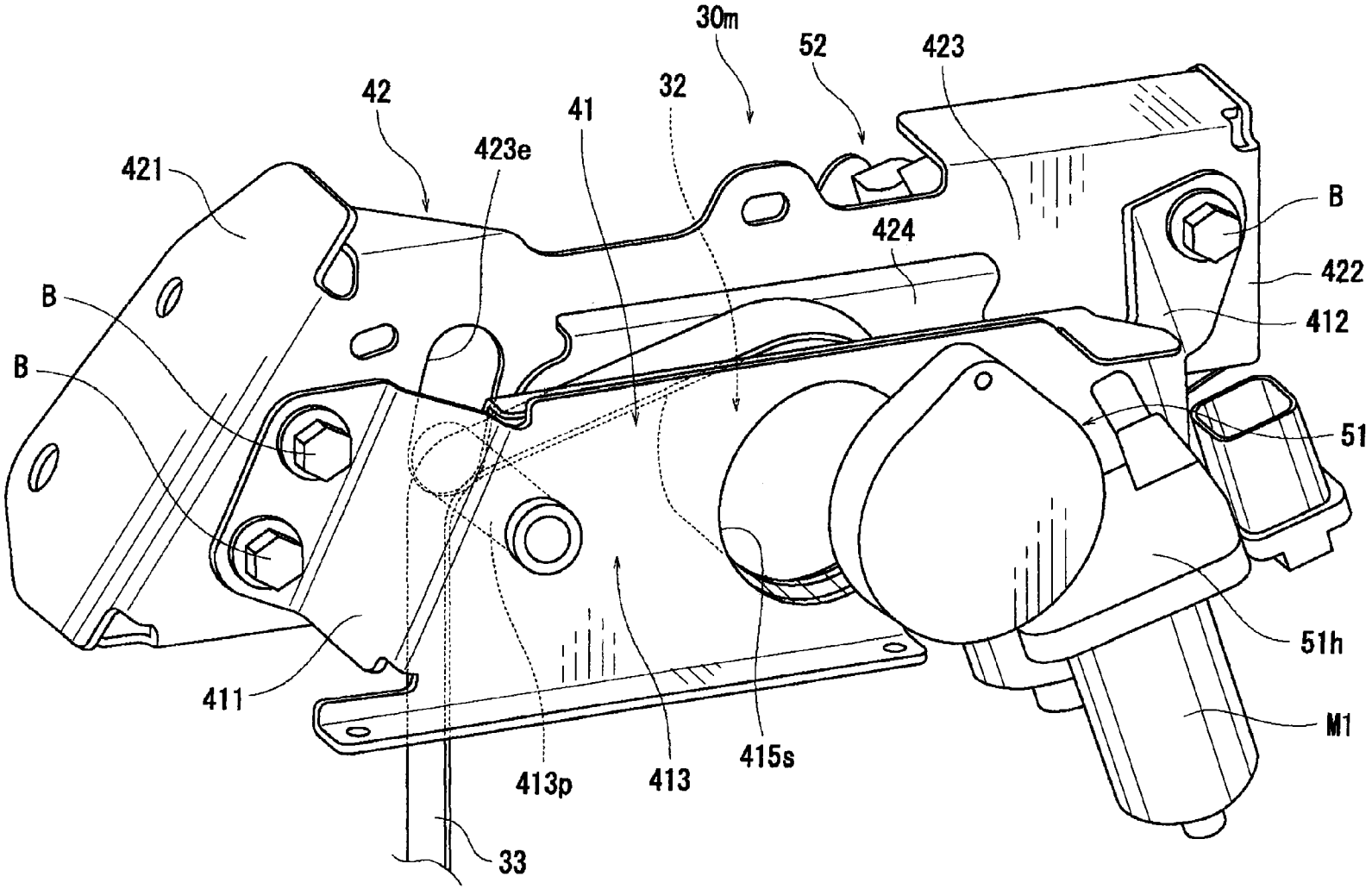
FIG. 2 is a full side view of the rotation device according to Embodiment 1 of the present invention.

As shown in FIGS. 1 and 2, the wind-up device has a suspension belt 33, a hook (not shown) that is connected to a distal end (lower end) of the suspension belt 33, and the rotation device 30*m* that is configured to be capable of winding or unwinding the suspension belt 33. The rotation device 30*m* has a drum 32. The drum 32 is attached to an upper end portion of the carrier 22 via a first bracket 41 and a second bracket 42 (FIG. 2).

As shown in FIG. 2, a first motor unit 51 for rotating the drum 32 is attached to the first bracket 41. Conversely, a second motor unit 52 for rotating the drum 32 is attached to the second bracket 42.

The drum 32 corresponds to a cylindrical rotating body of the present invention.

<Regarding the Drum 32>

As shown in FIGS. 5(A) and 5(B), the drum 32 is composed of a drum main body 320 around which the suspension belt 33 is wrapped, and a drive portion 330 that is capable of rotating the drum main body 320. The drum main body 320 has a cylindrical pulley portion 321, cylindrical portions 322 that are coaxially disposed in both of axial ends of the pulley portion 322, and flange-shaped disc portions 324 that are circumferentially attached to the cylindrical portions 322. The suspension belt 33 may be wrapped around a position between the disc portions 324. Formed in circumferential surfaces of the disk portions 324 are annular shouldered portions 324*d* that are respectively capable of being fitted to a support hole 415*s* of the first bracket 41 and a support hole 424*s* of the second bracket 42, which will be hereinafter described.

A through-hole 325 is axially formed in a core portion of the drum main body 320. The through-hole 325 is configured such that a support shaft 333 of the drive portion 330 can be passed therethrough. Further, dram-side gears 335*a* and 335*b* are respectively attached to both ends of the support shaft 333 that a projected from the through-hole 325 of the drum main body 320. The dram-side gears 335*a* and 335*b* respectively have a diameter smaller than the annular shouldered portions 324*d* and are attached to the support shaft 333 by crimping or other such methods. The support shaft 333 of the drive portion 330 passed through the through-hole 325 of the drum main body 320 is unrotatably secured to the drum main body 320 by a bolt or other such devices. As a result, the drum main body 320 and the drive portion 330 can rotate integrally.

The dram-side gears 335*a* and 335*b* correspond to rotating body-side gears of the present invention.

<Regarding the First Motor Unit 51 and the Second Motor Unit 52>

The first motor unit 51 and the second motor unit 52 have the same construction each other. Thus, a construction of the first motor unit 51 will be representatively described with reference to FIGS. 2 and 8.

Figure 8:
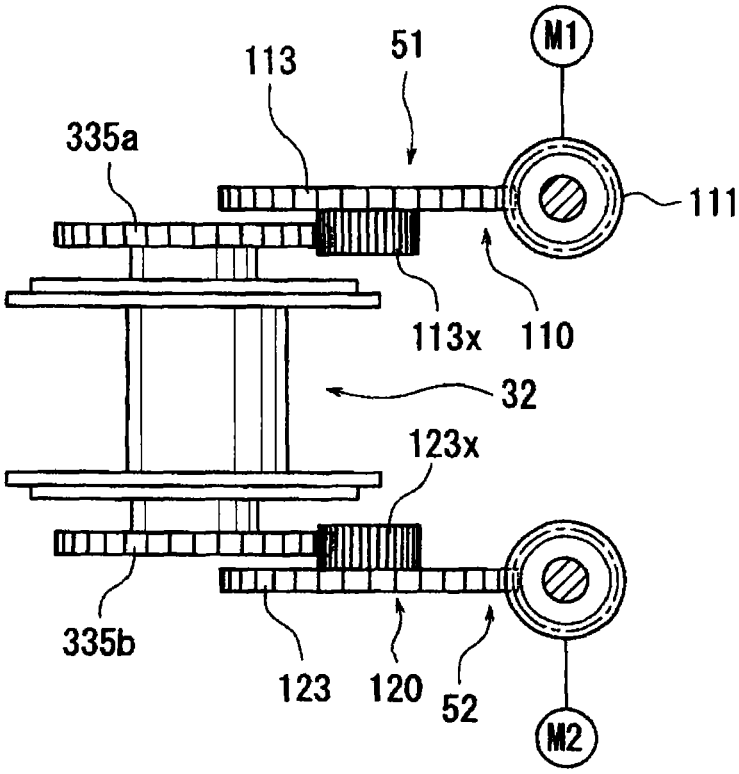
FIG. 8 is a side view, illustrating a relation between dram-side gears and a first gear and a second gear.
Figure 9:
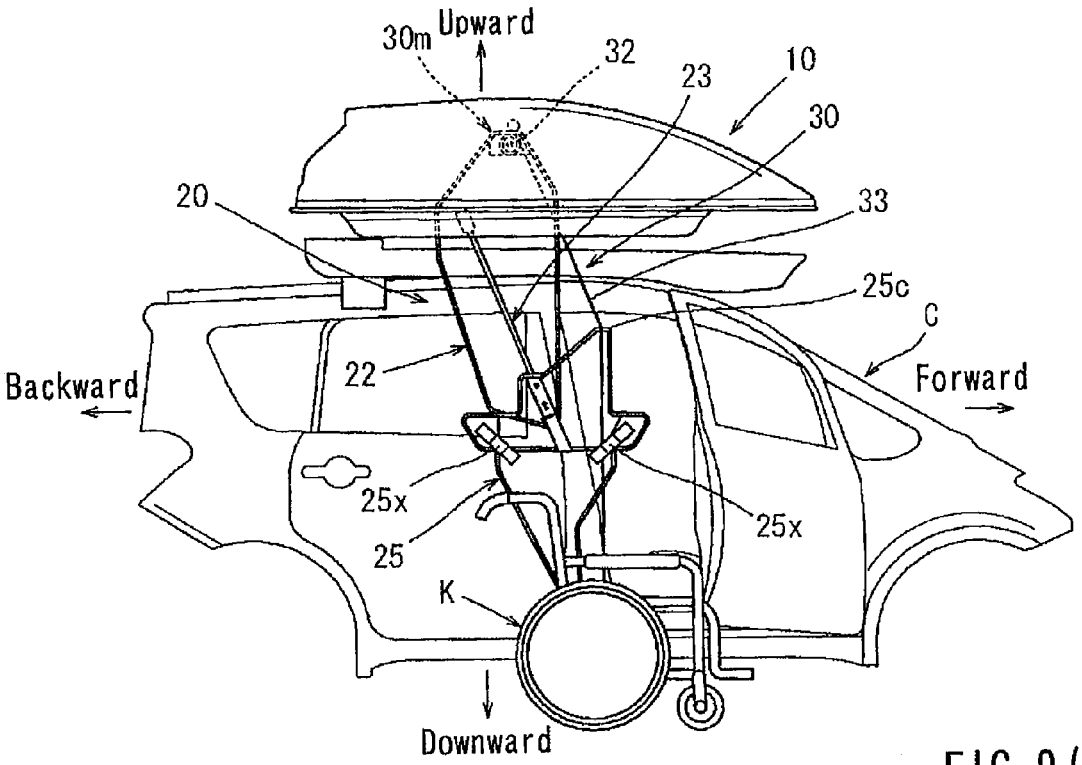
FIG. 9(A) is a side view of a wheelchair storing device having a wind-up device according to Embodiment 2 of the present invention, illustrating a wheelchair support portion and the wind-up device.
FIG. 9(B) is a perspective view of a hook and a suspension belt of the wheelchair storing device.
Figure 9:
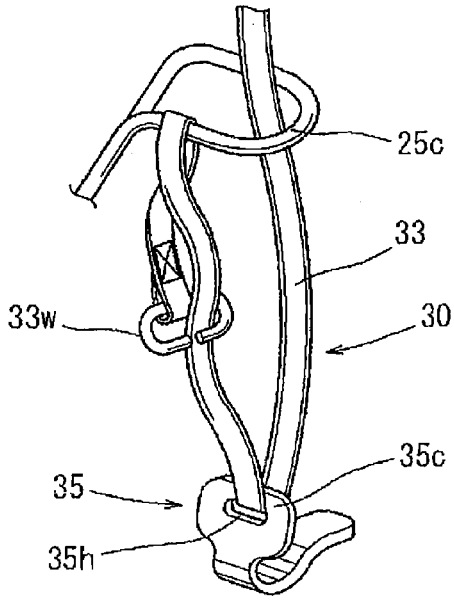
Figure 10:
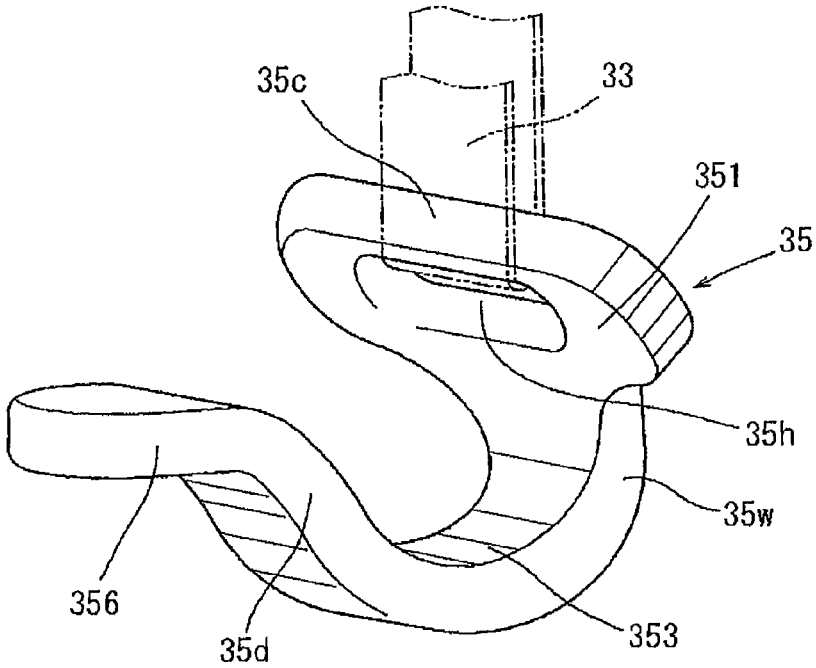
FIG. 10(A) is a perspective view of the hook of the wind-up device.
FIG. 10(B) is a side view of the hook.
Figure 10:
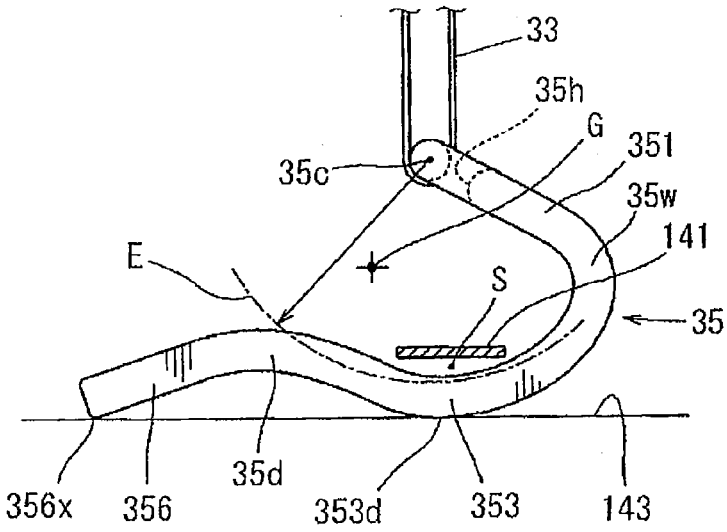

As shown in FIG. 8, the first motor unit 51 has a first motor M1 and a worm gear 110. The first motor M1 and the worm gear 110 are received in a motor housing 51*h* (FIG. 2). The worm gear 110 is composed of a worm 111 that is coaxially attached to a rotation shaft (not shown) of the first motor M1, and a worm wheel 113. A reduced diameter first gear 113*x* is coaxially attached to the worm wheel 113. Further, the first gear 113*x* is meshed with the dram-side gear 335*a* that is positioned at one end of the drum 32.

<Regarding the First Bracket 41 and the Second Bracket 42>

The first bracket 41 and the second bracket 42 are members that are capable of rotatably supporting the drum 32. Further, attached to the members are the first motor unit 51 and the second motor unit 52 that function to drive the drum 32.

Figure 3:
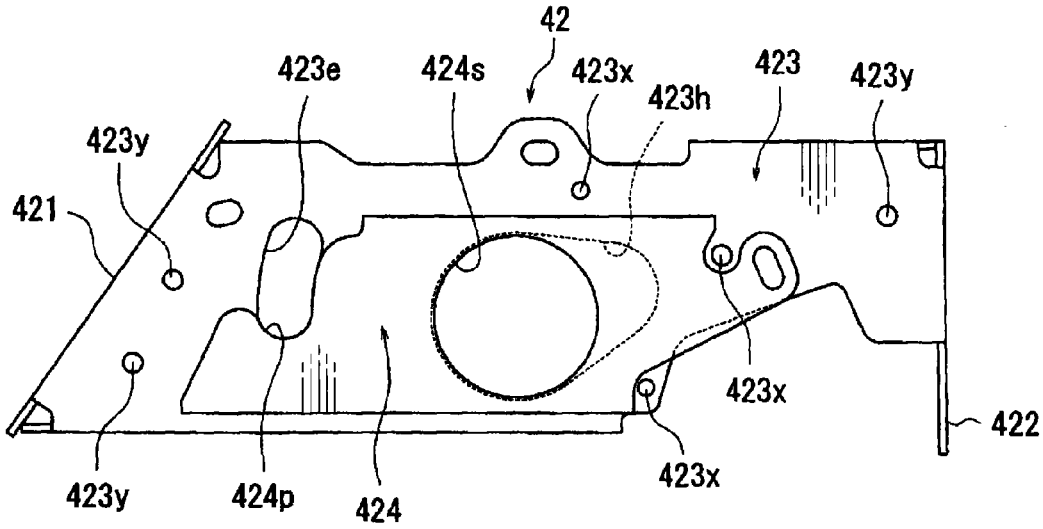
FIG. 3 is a plan view of a second bracket of the rotation device.
Figure 6:
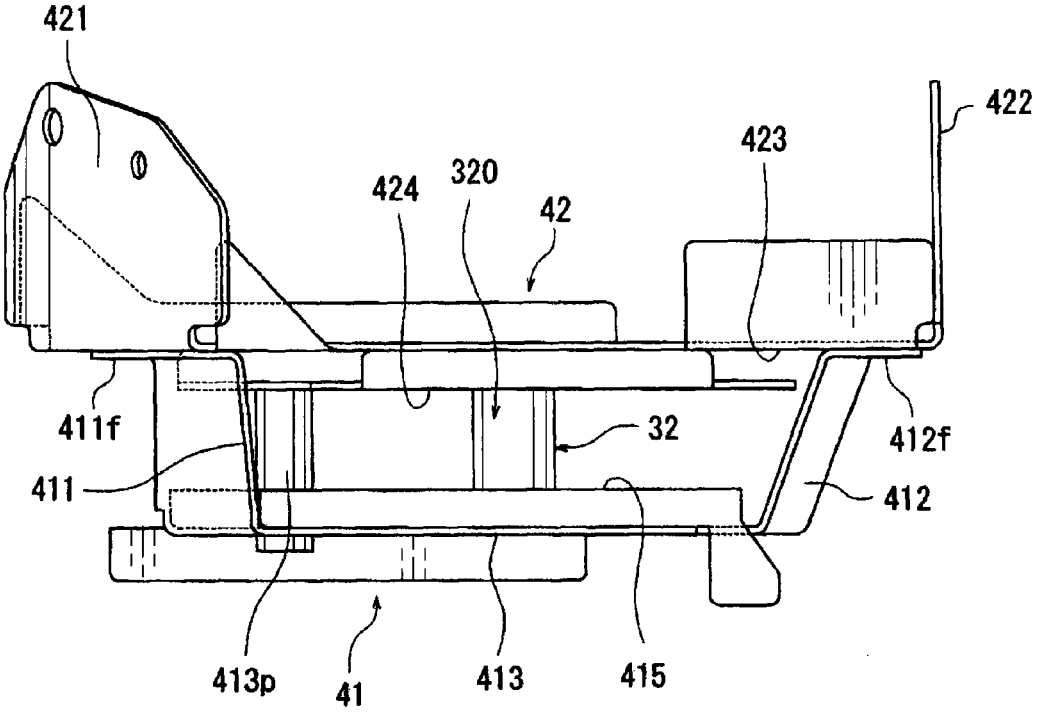
FIG. 6 is a plan view of FIG. 2.

As shown in, for example, FIGS. 2, 3, 6, the second bracket 42 is composed of a left plate portion 421, a right plate portion 422, and a flat plate portion 423 positioned between the two plate portions 421 and 422, and has a substantially gate-shape. The left plate portion 421 and the right plate portion 422 of the second bracket 42 are fixed to the carrier 22 of the above-mentioned wheelchair support portion 20 via, for example, bolts. As shown in FIG. 3, a substantially egg-shaped opening 423*h* (shown by broken line) is formed in a central portion of the flat plate portion 423 of the second bracket 42. Further, the opening 423*h* is wholly covered from before (from below in FIG. 6) by a front flat plate 424 that is positioned in parallel therewith at a distance. Further, formed in a central position of the front flat plate 424 is a support hole 424*s* that is capable of rotatably supporting the annular shouldered portion 324*d* of the drum main body 320. The support hole 424*s* is positioned to overlap the opening 423*h* of the flat plate portion 423.

Further, formed in a left portion of the flat plate portion 423 of the second bracket 42 is an arcuate elongated hole 423*e*. The elongated hole 423*e* is positioned such that a arc center thereof can be identical to a center of the support hole 424*s*. Further, formed in a left end of the front flat plate 424 is a stopper 424*p* that extends along a peripheral edge (a lower peripheral edge in FIG. 3) of the elongated hole 423*e* of the flat plate portion 423.

Further, formed in a right side of the opening 423*h* of the flat plate portion 423 are a plurality of (three) screw holes 423*x* that are positioned to surround the opening 423*h*. As shown in FIG. 2, the second motor unit 52 can be screwed on the screw holes 423*x* from behind. Further, respectively formed in a right end and a left end of the flat plate portion 423 are a screw hole 423*y* and two screw holes 423*y* that can be used to connect the first bracket 41, which will be hereinafter described, to the second bracket 42.

Figure 4:
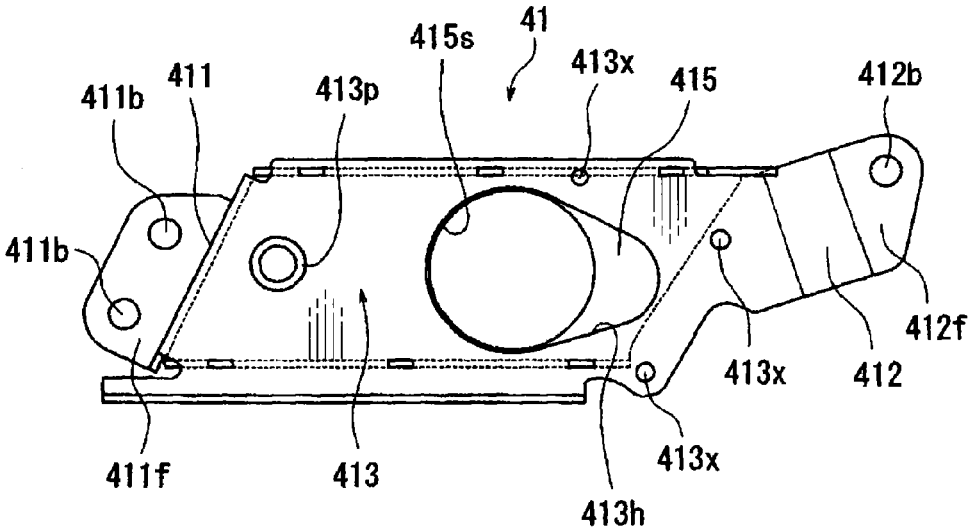
FIG. 4 is a plan view of a first bracket of the rotation device.
Figure 5:
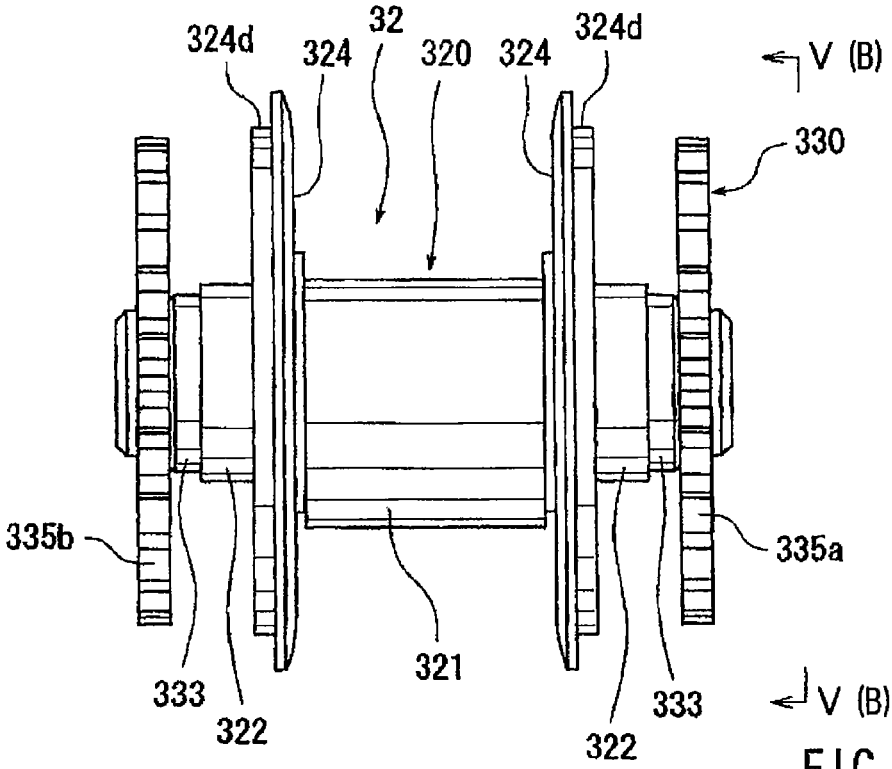
FIG. 5(A) is a side view of a drum of the rotation device.
FIG. 5(B) is a view of the drum that is viewed from line B-B of FIG. 5(A)
Figure 5:
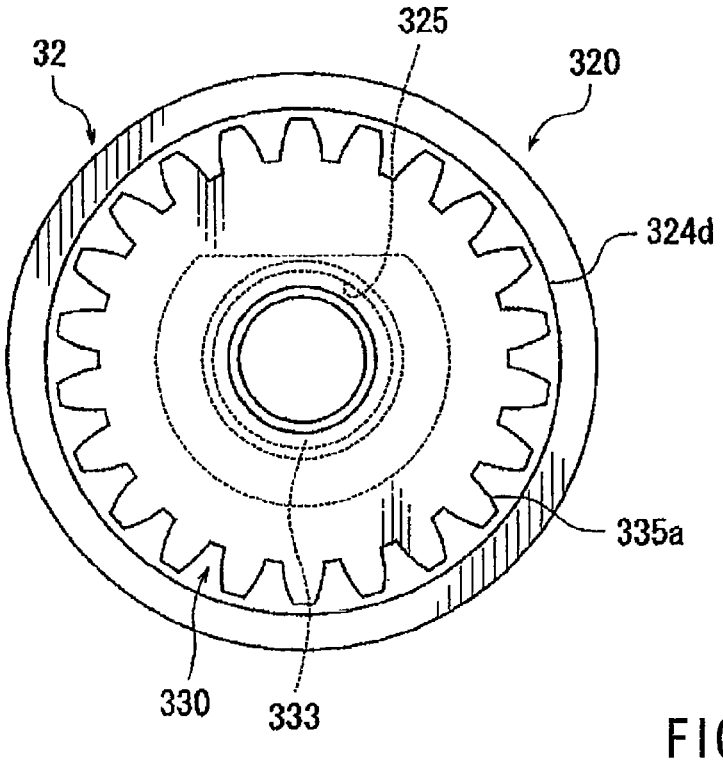

As shown in, for example, FIGS. 2, 4, 6, the first bracket 41 is composed of a left plate portion 411, a right side plate portion 412, and a flat plate portion 413 positioned between the two plate portions 411 and 412, and has a substantially gate-shape. As shown in FIG. 6, respectively formed in distal ends of the left plate portion 411 and the right plate portion 412 are formed laterally bent flange portions 411*f* and 412*f*. The flange portion 411*f* of the left plate portion 411 has two bolt holes 411*b* formed therein. Conversely, the flange portion 412*f* of the right plate portion 412 has a single bolt hole 412*b* formed therein. Further, as shown in FIG. 2, bolts B passed through the bolt holes 411*b* and 412*b* are screwed into the screw holes 423*y* of the second bracket 42, so that the first bracket 41 can be connected to the second bracket 42.

As shown in FIG. 4, a substantially egg-shaped opening 413*h* is formed in a central portion of the flat plate portion 413 of the first bracket 41. Further, the opening 413*h* is wholly covered from behind by a back flat plate 415 (FIG. 6) that is positioned in parallel therewith at a distance. Further, formed in a central position of the back flat plate 415 is a support hole 415*s* that is capable of rotatably supporting the annular shouldered portion 324*d* of the drum main body 320. The support hole 415*s* is positioned to overlap the opening 413*h* of the flat plate portion 413.

Attached to a left end portion of the flat plate portion 413 and the back side flat plate 415 of the first bracket 41 is a pin 413*p* that is positioned to correspond to the arcuate elongated hole 423*e* of the second bracket 42. The pin 413*p* is positioned to be perpendicular to the back flat plate 415 and is capable of being inserted into the elongated hole 423*e*. Therefore, as shown in FIGS. 2 and 6, the pin 413*p* of the first bracket 41 can be inserted into the elongated hole 423*e* of the second bracket 42 in a condition in which the annular shouldered portions 324*d* positioned in the axial ends of the pulley portion 322 are fitted to the support hole 415*s* of the first bracket 41 and the support hole 424*s* of the second bracket 42. Thus, in this condition, the first bracket 41 and the second bracket 42 can rotate relative to each other about the drum 32 by an amount corresponding to a length of the elongated hole 423*e*.

Further, formed in a right side of the opening 413*h* of the flat plate portion 413 of the first bracket 41 are a plurality of (three) screw holes 413*x* that are positioned to surround the opening 413*h*. As shown in FIG. 2, the first motor unit 52 can be screwed on the screw holes 413*x* from outside.

The pin 413*p* and the elongated hole 423*e* correspond to a guide mechanism of the present invention.

<Regarding Attachment of the Drum 32 to the Brackets 41 and 42>

First, the first motor unit 51 is attached to a predetermined position of the first bracket 41. Thereafter, the second motor unit 52 is attached to a predetermined position of the second bracket 42. Next, the annular shouldered portion 324*d* positioned on one end (a side facing the second bracket 42) of the drum 32 is fitted into the support hole 424*s* of the second bracket 42. Further, as shown in FIG. 8, the dram-side gear 335*b* positioned on the side facing the second bracket 42 of the drum 32 is meshed with the second gear 123*x* of the second motor unit 52. Next, the support hole 415*s* of the first bracket 41 is fitted to the annular shouldered portion 324*d* positioned on the other end (a side facing the first bracket 41) of the drum 32. Further, the pin 413*p* of the first bracket 41 is inserted into the elongated hole 423*e* of the second bracket 42. Subsequently, the first bracket 41 is gradually rotated to the right around the drum 32 with respect to the second bracket 42, so as to align teeth (tooth grooves) of the dram-side gear 335*a* of the drum 32 with tooth grooves (teeth) of the first gear 113*x* of the first motor unit 51, thereby meshing the two gears 335*a* and 113*x* with each other.

Figure 7:
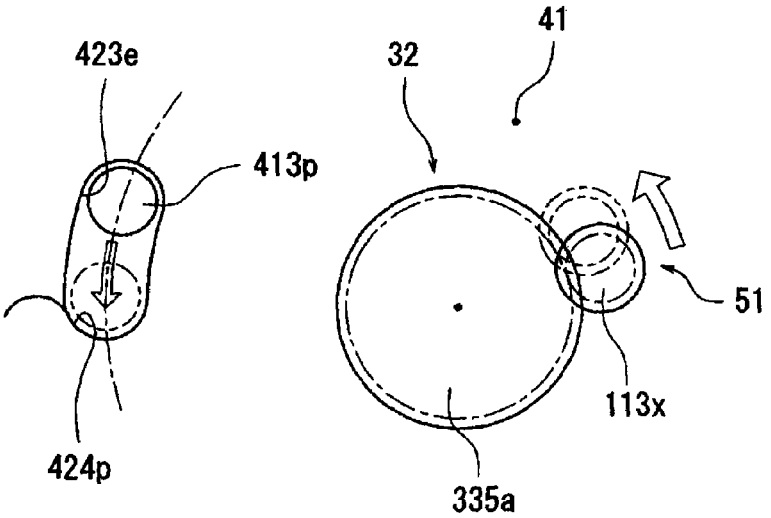
FIG. 7 is a plan view of a guide mechanism, illustrating function thereof.

Thereafter, the first motor M1 of the first motor unit 51 is driven to rotate the first gear 113*x* to the left in FIG. 7, so as to rotate the first bracket 41 to the left around the drum 32 with respect to the second bracket 42. In a condition in which the pin 413*p* of the first bracket 41 contacts the stopper 424*p* of the elongated hole 423*e* of the second bracket 42, the first motor M1 is stopped. In this condition, the bolt holes 411*b* and 412*b* of the first bracket 41 overlap the screw holes 423*y* of the second bracket 42. Next, the bolts B are inserted into the bolt holes 411*b* and 412*b* and are then screwed into the screw holes 423*y*, so that the first bracket 41 can be connected to the second bracket 42. In this condition, the attachment of the drum 32 to the first bracket 41 and the second bracket 42 can be completed.

Further, positions of the first motor unit 51 and the second motor unit 52 when the pin 413*p* of the first bracket 41 contacts the stopper 424*p* of the elongated hole 423*e* of the second bracket 42 and when the bolt holes 411*b* and 412*b* of the first bracket 41 overlap the screw holes 423*y* of the second bracket 42 correspond to normal attachment positions in the present invention.

<Advantages of the Rotation Device 30*m* According to the Present Embodiment>

According to the rotation device 30*m* of the present embodiment, the pin 423*p* and the elongated hole 423*e* (the guide mechanism) are disposed between the first bracket 41 and the second bracket 42. The pin 423*p* and the elongated hole 423*e* are configured to relatively rotatably guide the first motor unit 51 and the second motor unit 52 around the drum 32. Thus, for example, in a condition in which the second motor unit 52 is maintained in the normal attachment position and in which the second gear 123*x* and the dram-side gear 335*b* are meshed with each other, the first motor unit 51 can be gradually rotated (moved) around the drum 32 with respect to the second motor unit 52 and the dram-side gears 335*a* and 335*b*, so as to align the teeth (the tooth grooves) of the first gear 113*x* with the tooth grooves (the teeth) of the dram-side gear 335*a*.

Further, after the first gear 113*x* and the second gear 123*x* are completely meshed with the dram-side gears 335*a* and 335*b*, the first motor unit 51 can be moved to the normal attachment position around the drum 32 using the pin 413*p* and the elongated hole 423*e* (the guide mechanism).

Thus, a meshing operation of the first gear 113*x* of the first motor unit 51 and the dram-side gear 335*a* and a meshing operation of the second gear 123*x* of the second motor unit 52 and the dram-side gear 335*b* can be easily performed, so that efficiency of an attaching operation of the motors to the drum 32 can be increased.

Further, the bracket is composed of the first bracket 41 and the second bracket 42 that are capable of supporting one end and the other end of the drum 32. Therefore, the attachment of the drum 32 to the bracket can be easily performed. Further, the first motor unit 51 is attached to the first bracket 41, and the second motor unit 52 is attached to the second bracket 42.

Therefore, the meshing operations of the first gear 113*x* and the second gear 123*x* and the dram-side gears 335*a* and 335*b* can be easily performed.

Further, the dram-side gears 335*a* and 335*b* are respectively positioned at one end side and the other end side in an axial direction of the drum 32. Further, the dram-side gear 335*a* positioned at one end side in the axial direction of the drum 32 is meshed with the first gear 113*x*. Conversely, the dram-side gear 335*b* positioned at the other end side in the axial direction of the drum 32 is meshed with the second gear 123*x*. That is, a rotational force can be applied to both sides in the axial direction of the drum 32, so that the drum 32 can be rotated in a well-balanced manner.

Further, the guide mechanism is constructed of the pin 413*p* and the arcuate elongated hole 423*e* that is capable of guiding the pin 413*p*. Further, the suspension belt 33 wrapped around the drum 32 can be supported by the pin 413*p*. As a result, a construction of the guide mechanism can be simplified. In addition, the guide mechanism can be used as a guide of the suspension belt 33.

<Modified Forms>

Further, the present invention is not limited to the embodiment described above and can be modified without departing from the scope of the present invention. For example, in the rotation device 30*m* of the present embodiment, the guide mechanism is constructed of the pin 413*p* and the elongated hole 423*e*. However, the guide mechanism can be constructed of a ridge and an arcuate groove that is capable of guiding the ridge.

Further, in the present embodiment, the drum 32 is supported by the first bracket 41 and the second bracket 42. However, the drum can be supported by a single bracket, so that the first motor unit 51 or the second motor unit can be supported by the guide mechanism while it can be rotated around the drum with respect to the bracket.

Further, in the embodiment, the wind-up device 30 of the vehicle wheelchair storing device 10 is exemplified. However, the present invention can be applied to a wind-up device used in a winch, a crane-carrying truck or other such devices.

Embodiment 2

In the following, a wind-up device according to Embodiment 2 of the present invention will be described with reference to FIGS. 9 to 12 and 18. The wind-up device according to the present embodiment is used in a wheelchair storing device that is capable of folding up a wheelchair while lifting up the same and storing the wheelchair on a roof of a passenger automobile. Further, forward and backward, rightward and leftward, and upward and downward in the drawings respectively correspond to forward and backward, rightward and leftward, and upward and downward of the passenger automobile and the wheelchair.

<Conventional Construction>

As shown in FIGS. 18(A) and 18(B), in a conventional wind-up device, when a wheelchair K is lifted up, a hook 115 attached to a distal end of a suspension belt 110 is held by hand and is then hooked on a hook receiving belt 100 of the wheelchair K. Thus, as shown in FIG. 18(B), the hook 115 is manufactured as thin as possible and as light as possible for easy handling.

However, in the wind-up device described above, it is necessary to hold the hook 115 by hand and to hook the same on the hook receiving belt 100 of the wheelchair K. Therefore, it is rather difficult to perform this operation for a person who does not have the full use of his/her fingers. In particular, since the hook 115 is manufactured thin, the hook 115 can be turned over on a seating surface of the wheelchair K when it is lowered onto the seating surface. Therefore, it is rather difficult to grasp the hook 115 for the person who does not have the full use of his/her fingers.

It is an object of the present invention to provide a wind-up device in which a hook lowered onto a seating surface of a wheelchair can be easily hooked on a hook receiving belt provided to the seating surface of the wheelchair for a person who does not have the full use of his/her fingers.

<Outline of the Vehicle Wheelchair Storing Device 10>

The vehicle wheelchair storing device 10 is a device for lifting up a wheelchair K and storing the same on a roof of an automobile C after a driver has moved from the wheelchair K to a driver's seat of the automobile C.

The vehicle wheelchair storing device 10 has a wheelchair support portion 20 that is configured to be vertically rotatable between a raised position shown in FIG. 9(A) and a horizontal position (not shown), and an device main body portion (not shown) that is configured to laterally slide the wheelchair support portion 20 in the horizontal position to a storing position on the roof.

The wheelchair support portion 20 is composed of a carrier 22 that is vertically rotatably connected to the device main body portion, a protector 25 that is capable of restraining the wheelchair K folded up in the course of being lifted up in a predetermined position, a guide mechanism 23 that vertically slidably connects the protector 25 to the carrier 22, and the wind-up device 30 that is capable of lifting up the wheelchair K and the protector 25 with respect to the carrier 22.

As shown in FIGS. 9(A) and 9(B), the wind-up device has a suspension belt 33, a hook 35 that is connected to the suspension belt 33, and a rotation device 30*m* that is configured to be capable of winding or unwinding the suspension belt 33. The rotation device 30*m* has a drum 32 that is attached to an upper end portion of the carrier 22.

The drum 32 is attached to the upper end portion of the carrier 22 via a first bracket 41 and a second bracket 42 (FIG. 2).

As shown in FIG. 2, a first motor unit 51 for rotating the drum 32 is attached to the first bracket 41. Conversely, a second motor unit 52 for rotating the drum 32 is attached to the second bracket 42.

As shown in FIG. 9(B), an intermediate portion of the suspension belt 33 is passed through a suspension support portion 25*c* formed an upper end of the protector 25. A distal end portion of the suspension belt 33 is connected to a construction element of the suspension support portion 25*c* using a snap ring 33*w*. Further, a support 35*c* of the hook 35 is supported by the intermediate portion of the suspension belt 33 passed through the suspension support portion 25*c* of the protector 25. That is, the hook 35 is supported by the suspension belt 33 below the suspension support portion 25*c* of the protector 25, so as to be movable along the intermediate portion of the suspension belt 33.

Figure 11:
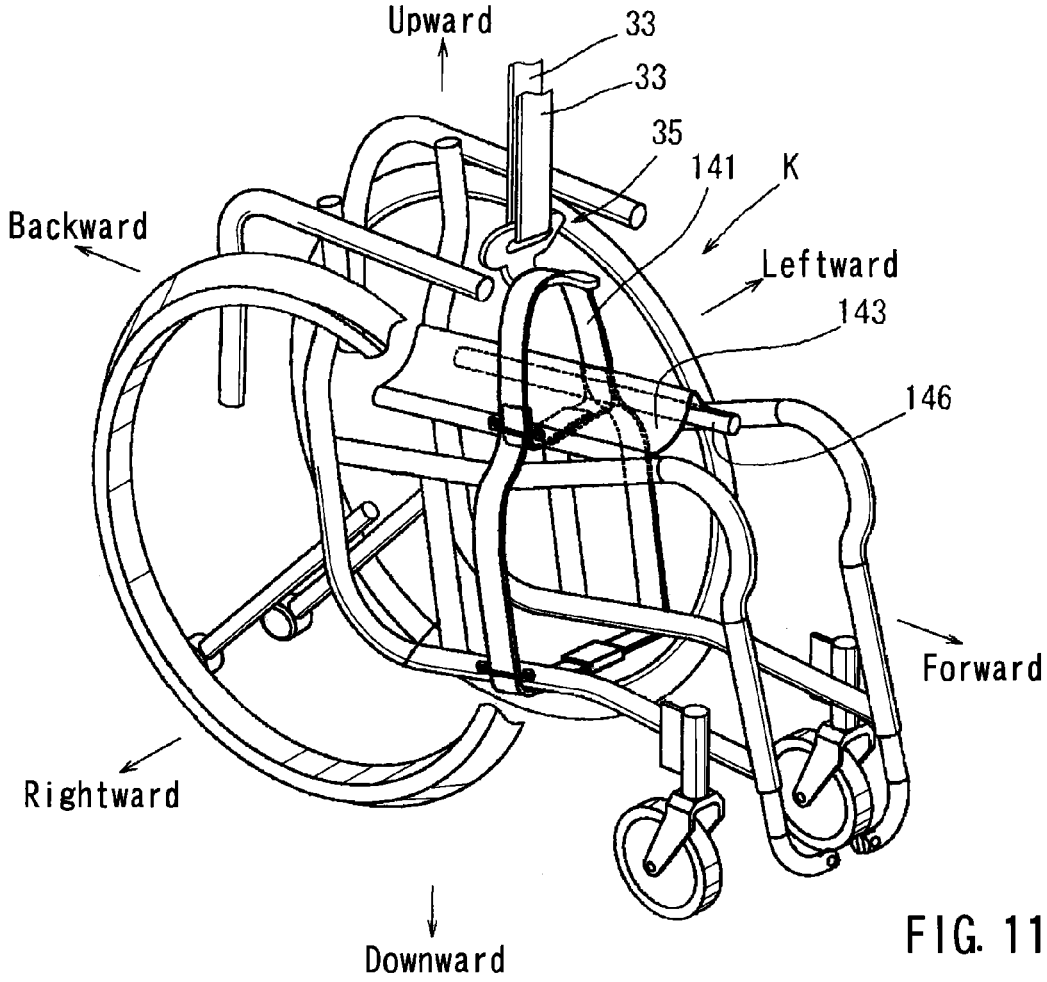
FIG. 11 is a perspective view illustrating a condition in which a wheelchair is lifted up.

According to the above construction, as shown in FIG. 11, when the suspension belt 33 is wound up after the hook 35 is hooked on a hook receiving belt 141 of the wheelchair K, the wheelchair K can be initially lifted up alone while the protector 25 is remaining without any change. At this time, as shown in FIG. 9(B), the hook 35 is supported from both of a distal end side and a proximal end side (a side corresponding to the drum 32) of the suspension belt 33. Therefore, as compared with a case in which the hook 35 is suspended at one point, a tensile force applied to the drum 32 can be reduced to one-half.

The wheelchair K is folded up in the course of being lifted up. Further, the wheelchair K moves upward alone until the hook 35 contacts the suspension support portion 25*c* of the protector 25. Thereafter, at a stage in which the hook 35 contacts the suspension support portion 25*c* of the protector 25, the wheelchair K contacts a wheelchair restraining plate 25*x* (FIG. 9(A)) of the protector 25, and is restrained at this position. Further, in this condition, when the suspension belt 33 continues to be wound up, the wheelchair K is lifted up together with the protector 25. That is, the wheelchair K and the protector 25 can move upward with respect to the carrier 22 by the action of the guide mechanism 23. In a condition in which the wheelchair K and the protector 25 reaches an upper limit position with respect to the carrier 22, a winding up operation of the suspension belt 33 is stopped. Next, the carrier 22 rotates to a horizontal position, so that the protector 22 and the wheelchair K are positioned on the carrier 22. In this condition, the device main body portion laterally slides the wheelchair support portion 20 (the protector 25 and the carrier 22) to the storing position on the roof. Thus, a storing operation of the wheelchair K is completed.

<Regarding the Hook 35 of the Wind-Up Device 30>

As shown in FIGS. 10(A) and 10(B), the hook 35 of the wind-up device 30 is constructed to stands on its own in the same posture as the posture when it is hooked on the hook receiving belt 141 of the wheelchair K in a condition in which it is lowered onto a seating surface 143 of the wheelchair K. The hook 35 has a hook proximal end portion 351 having the support 35*c*, a belt engagement portion 353 on which the hook receiving belt 141 of the wheelchair K is hooked, and a guide portion 356 that is configured to guide the hook receiving belt 141 to a position of the belt engagement portion 353.

As shown in FIG. 10(A), the hook proximal end portion 351 has a substantially elliptical shape elongated in a width direction, and has a laterally elongated belt hole 35*h* that is formed in an upper portion of the hook proximal end portion 351. The suspension belt 33 of the wind-up device 30 is passed through the belt hole 35*h*, so as to support the lateral shaft-shaped support 35*c* formed in an upper side of the belt hole 35*h*.

As shown in FIG. 10(A), the belt engagement portion 353 is a strip-shaped portion having a width dimension smaller than a width dimension of the hook proximal end portion 351. As shown in FIG. 10(B), the belt engagement portion 353 has substantially arcuate shape in side view. Further, a laterally-faced curved portion 35*w* is formed between a proximal end portion of the belt engagement portion 353 and a lower end central portion of the hook proximal end portion 351. As shown in FIG. 10(B), the curvature of the laterally-faced curved portion 35*w* is set such that the support 35*c* of the hook proximal end portion 351 can be positioned substantially directly above the belt engagement portion 353. Thus, in the condition in which the hook 35 is lowered onto the seating surface 143 of the wheelchair K, a substantially central lower surface 353*d* of the belt engagement portion 353 and portions in the vicinity thereof can contact the seating surface 143 of the wheelchair K. Further, a radius of curvature of the substantially arcuate belt engagement portion 353 is set to have a value smaller than a radius of curvature of an imaginary arc E that is centered on the support 35*c* of the hook proximal end 351 and passes through a surface of the belt engagement portion 353. Thus, even when the hook 35 swings in a rotating direction about the support 35*c*, the hook receiving belt 141 of the wheelchair K can be prevented from being easily disengaged from the belt engagement portion 353 of the hook 35.

The guide portion 356 has the same width dimension as the belt engagement portion 353, and has a flat strip-shape. Further, a downwardly curved portion 35*d* is formed between a proximal end portion of the guide portion 356 and a distal end of the belt engagement portion 353. The downwardly curved portion 35*d* is a portion that functions to downwardly curve the guide portion 356 with respect to the belt engagement portion 353 with a gentle curvature. A length dimension of the guide portion 356 is set such that the center of gravity G of the hook 35 can be positioned in front of the support 35*c* of the hook proximal end portion 351.

Thus, because the center of gravity G of the hook 35 is positioned in front of the support 35*c*, when the hook 35 is suspended and lowered by the suspension belt 33, a distal end side (a side corresponding to the guide portion 356) of the hook 35 can be positioned in a lowermost position, so that a distal end lower side 356*x* of the guide portion 356 first contacts the seating surface 143 of the wheelchair K. When the hook 35 is successively lowered, the central lower surface 353*d* of the belt engagement portion 353 and the portions in the vicinity thereof can contact the seating surface 143 of the wheelchair K (FIG. 10(B)).

The distal end lower side 356*x* of the hook 35, and the central lower surface 353*d* of the belt engagement portion 353 and the portion in the vicinity thereof correspond to a seating surface contact portion of the hook of the present invention. Therefore, a distance from the distal end lower side 356*x* of the guide portion 356 to the central lower surface 353*d* of the belt engagement portion 353 and the portion in the vicinity thereof corresponds to a distance from a front end position to a rear end position of the seating surface contact portion. Further, the width dimension of each of the guide portion 356 and the belt engagement portion 353 is identical to a distance from a left end to a right end of the seating surface contact portion.

Further, the distance from the distal end lower side 356*x* of the guide portion 356 to the central lower surface 353*d* of the belt engagement portion 353 and the portion in the vicinity thereof, and the width dimension of the guide portion 356 and the belt engagement portion 353 are set to values that allow the hook 35 to stably stand on its own on the seating surface 143 in the condition in which the hook 35 is lowered onto the seating surface 143 of the wheelchair K, that is, in a condition in which no tensile force of the suspension belt 33 is applied to the hook 35.

Figure 12:
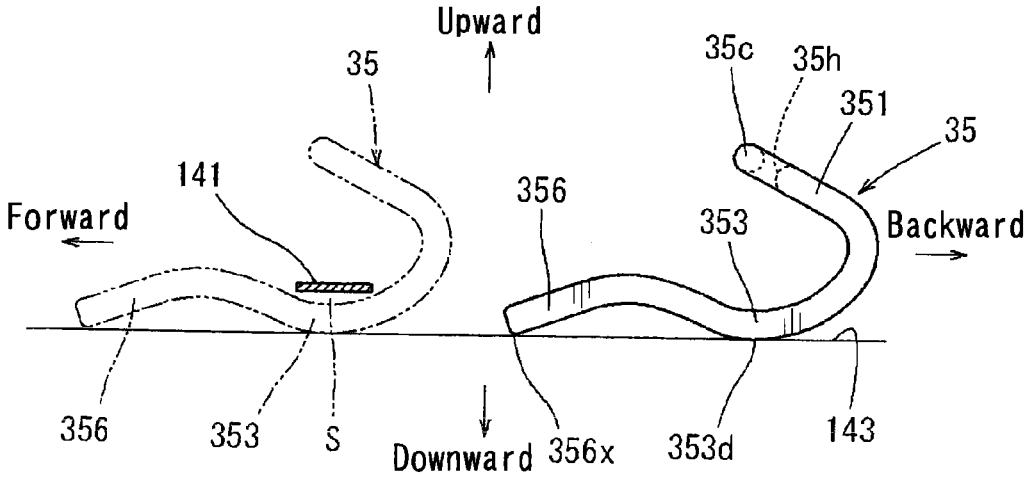
FIG. 12 is a side view of the hook, illustrating function thereof.

Thus, as shown in FIG. 12, for example, when the hook 35 is pushed along the seating surface 143 after the hook 35 is lowered onto the seating surface 143 of the wheelchair K, the hook 35 can be moved along the seating surface 143 of the wheelchair K.

The hook 35 is formed of a core member made of a steel plate and a resin such as nylon that covers the core member.

<Regarding Function of the Hook 35>

The hook receiving belt 141 is disposed on the seating surface 143 of the wheelchair K, so as to extend across the seating surface 143. Both end portions of the hook receiving belt 141 are connected to a frame 146 (FIG. 11) of the wheelchair K. Thus, as shown in FIGS. 10(B) and 12, a gap S is formed between the central portion of the hook receiving belt 141 and the seating surface 143.

Thus, as shown in FIG. 12, when the hook 35 is pushed forwardly to be advanced on the seating surface 143 after the hook 35 is lowered onto the seating surface 143 of the wheelchair K, the distal end of the guide portion 356 of the hook 35 can be inserted into the gap S formed between the seating surface 143 and the hook receiving belt 141. The hook 35 is further pushed forwardly in this condition, as shown by chain double-dashed line in FIG. 12, the hook receiving belt 141 can be relatively moved from a position of to the guide portion 356 to a position of the belt engagement portion 353. That is, a posture of the hook 35 when it lowered onto the seating surface 143 of the wheelchair K is the same as a posture of the hook 35 when it is hooked on the hook receiving belt 141 of the wheelchair K. Therefore, the hook 35 can be hooked on the hook receiving belt 141 of the seating surface 143 by simply pushing the hook 35 in a lateral direction (forwardly).

<Advantages of the Wind-Up Device 30 According to the Present Embodiment>

According to the wind-up device 30 of the present embodiment, in the condition in which the hook 35 is lowered onto the seating surface 143 of the wheelchair K, the hook 35 can stand on its own in the same posture as the posture when it is hooked on the hook receiving belt 141 of the wheelchair K. As a result, after the hook 35 is lowered onto the seating surface 143 of the wheelchair K, when the hook 35 is moved to a position of the hook receiving belt 141 while it is pushed along the seating surface 143, the hook 35 can be hooked on the hook receiving belt 141 of the seating surface 143. That is, there is no need to hold the hook 35 and to hook the same on the hook receiving belt 141. Therefore, it is possible to easily hook the hook 35 on the hook receiving belt 141 for a person who does not have the full use of his/her fingers Further, as shown in FIG. 12, when the hook 35 is moved along the seating surface 143 of the wheelchair K, the guide portion 356 of the hook 35 always contacts the seating surface 143, so as to enter the gap S formed between the seating surface 143 and the hook receiving belt 141. Thus, when the hook 35 is pushed, the guide portion 356 of the hook 35 can be pushed into the gap S formed between the seating surface 143 and the hook receiving belt 141, so that the hook receiving belt 141 can be reliably guided to a position of the belt engagement portion 353.

Further, the radius of curvature of the belt engagement portion 353 of the hook 35 is set to have a value smaller than the radius of curvature of the imaginary arc E that is centered on the support 35*c* of the hook proximal end 351 and passes through the surface of the belt engagement portion 353. Thus, even when the hook 35 swings in the rotating direction about the support 35*c*, the hook receiving belt 141 of the wheelchair K can be prevented from being easily disengaged from the belt engagement portion 353 of the hook 35.

<Modified Forms>

Further, the present invention is not limited to the embodiment and can be modified without departing from the scope of the present invention. For example, in the hook 35 of the present embodiment, the width dimension of each of the belt engagement portion 353 and the guide portion 356 is set to be smaller than the width dimension of the hook proximal end portion 351. However, the width dimension of each of the belt engagement portion 353 and the guide portion 356 can be set to be equal to the width dimension of the hook proximal end portion 351.

Further, in the present embodiment, in the condition in which the hook 35 is lowered onto the seating surface 143 of the wheelchair K, two portions, i.e., the distal end lower side 356*x* of the guide portion 356 and the central lower surface 353*d* of the belt engagement portion 353 can contact the seating surface 143 of the wheelchair K. However, in a portion between the distal end lower side 356*x* and the central lower surface 353*d* of the hook 35, the entire lower side of the hook 35 can be flattened, so that a lower surface thereof can entirely contact the seating surface 143 of the wheelchair K. According to this structure, a posture of the hook 35 that stands on its own on the seating surface 143 of the wheelchair K can be stabilized.

Further, in the embodiment, the hook 35 is formed of the core member made of the steel plate and a covering member made of nylon. However, the hook 35 can be formed of various materials.

Embodiment 3

In the following, a wind-up device according to Embodiment 3 of the present invention will be described with reference to FIGS. 13 to 17. The wind-up device according to the present embodiment is intended to improve a connection structure of the hook 35 and the suspension belt 33. Because the wind-up device has the same construction as the wind-up device 30 of the Embodiment 1 other than the connection structure. Therefore, elements that are the same as the elements of the second embodiment will be identified by the same reference numerals and a detailed description of such elements will be omitted.

<Conventional Connection Structure>

As shown in FIG. 13(E), conventionally, the lateral shaft-shaped support 35*c* of the hook 35 is directly inserted into a tubular portion W formed in a distal end portion of the suspension belt 33, so that the suspension belt 33 and the hook 35 are connected to each other. Further, the tubular portion W is formed by wrapping a distal end vicinity portion 33*a* of the suspension belt 33 around the lateral shaft-shaped support 35*c* and by sewing a belt distal end 33*t* on a side surface of the distal end vicinity portion 33*a*.

However, according to the construction described above, for example, in order to detach the hook 35 from the suspension belt 33, a thread of a sewn portion must be cut, so that the belt distal end 33*t* can be removed from the side surface of the distal end vicinity portion 33*a*. Further, in order to attaché a new hook 35 to the suspension belt 33, the belt distal end 33*t* must be sewn on the side surface of the distal end vicinity portion 33*a*. Thus, it is rather difficult to singly replace the hook 35 and the suspension belt 33 with new ones.

<Connection Structure Using the Snap Ring 60>

In order to achieve an improvement in this connection, as shown in FIG. 13(C), the hook 35 and the suspension belt 33 are connected to each other using a snap ring 60. The snap ring 60 is a substantially oval annular member. The snap ring 60 is composed of one side portion 61 having a linear shape, the other side portion 62 having a similarly linear shape and positioned opposite to one side portion 61 across a center, and semi-circular arcuate portions 63 respectively connecting one and the other side of one side portion 61 and one and the other side of the other side portion 62. As shown in FIG. 13(C), the snap ring 60 is cut off at a central position of the other side portion 62, so as to have a gap 65 that is formed in a cut-off portion. Further, a width dimension of the gap 65 is set to have a value somewhat larger than a thickness dimension of the suspension belt 33. Thus, it is possible to guide the suspension belt 33 to an inside of the snap ring 60 from an outside thereof using the gap 65. A length dimension of the snap ring 60, i.e., a dimension between an outer peripheral surface of one of the arcuate portions 63 and an outer peripheral surface of the other of the arcuate portions 63, is set to be smaller than the width dimension of the hook proximal end portion 351 of the hook 35 (a length dimension as measured along the support 35*c*) (for example, FIG. 14).

FIG. 13(D) shows an example of the connection structure of the hook 35 and the suspension belt 33 using the snap ring 60. In this connection structure, the suspension belt 33 is first passed through the belt hole 35*h* of the hook 35. Thereafter, the tubular portion W of the suspension belt 33 is engaged with one side portion 61 of the snap ring 60 using the gap 65 of the snap ring 60.

Next, a halfway portion 33*e* of the suspension belt 33 positioned between the support 35*c* of the hook 35 and the drum 32 (not shown in FIGS. 13(A) to 13(E)) is guided to the inside of the snap ring 60 via the gap 65 of the snap ring 60, so as to be passed through the snap ring 60. As a result, as shown in FIG. 13(D), the hook 35 and the suspension belt 33 can be connected to each other via the snap ring 60. According to this connection structure, the hook 35 can be easily disengaged from the suspension belt 33 by performing a reverse procedure of the procedure described above. Thus, the hook 35 and the suspension belt 33 can be singly replaced with new ones.

However, in the above-described connection structure, the halfway portion 33*e* of the suspension belt 33 is engaged with the support 35*c* of the hook 35 only once. Therefore, in a condition in which no tensile force is applied to the suspension belt 33, a connecting portion of the suspension belt 33 and the hook 35 can be easily loosened. Thus, when the suspension belt 33 is wound up in a condition in which the suspension belt 33 is loosened, the snap ring 60 hits the support 35*c* of the hook 60 while the distal end portion of the suspension belt 33 is tightened. That is, each time the suspension belt 33 is wound up, the snap ring 60 hits the hook 60. This may lead to generation of noise and damage of the hook 60 and other components with time.

Further, when the suspension belt 33 is wound up, only one side portion 61 can be pulled toward the support 35*c* of the hook 35. As a result, the snap ring 60 can be inclined. Therefore, when the hook 35 is wound up to an upper limit position, a portion of the snap ring 60 first contacts a hook stopper 67 shown in FIGS. 17(A) and 17(B). As a result, the hook 35 can precariously swing. Thus, it is necessary to provide additional members that are capable of preventing the hook 35 from interfering with other surrounding components.

In order to solve this problem, in a connection structure of the present embodiment using the snap ring 60, the hook 60 and the suspension belt 33 are connected to each other in a manner shown in FIGS. 13(A) and 13(B).

<Connection Structure of the Present Embodiment Using the Snap Ring 60>

Figure 14:
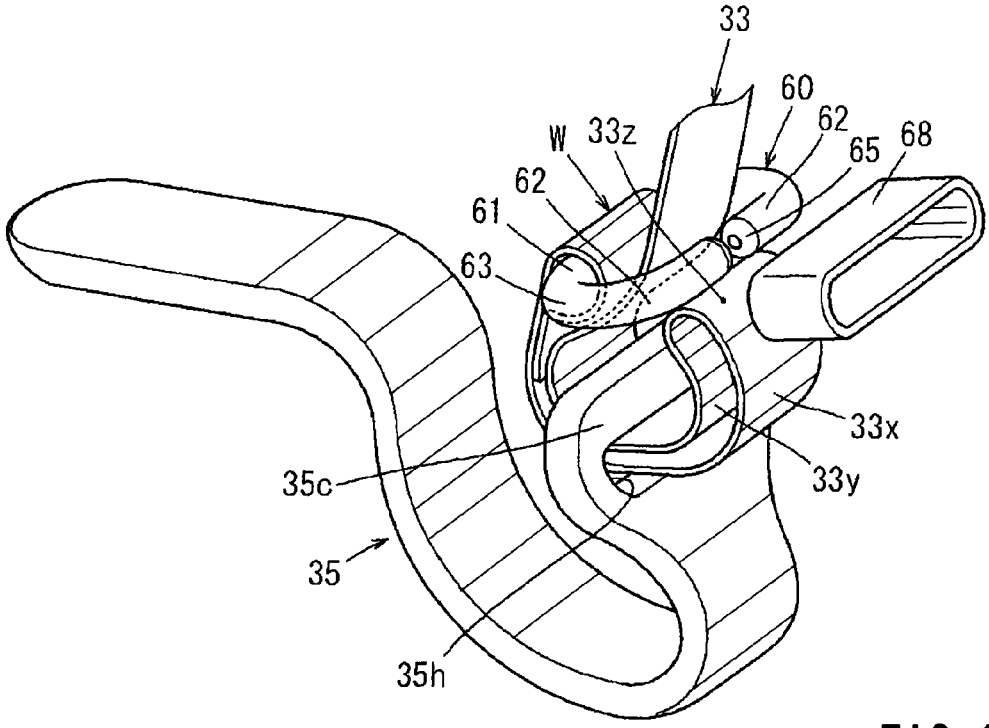
FIG. 14 is a perspective view illustrating procedures for connecting the hook and the suspension belt.
Figure 15:
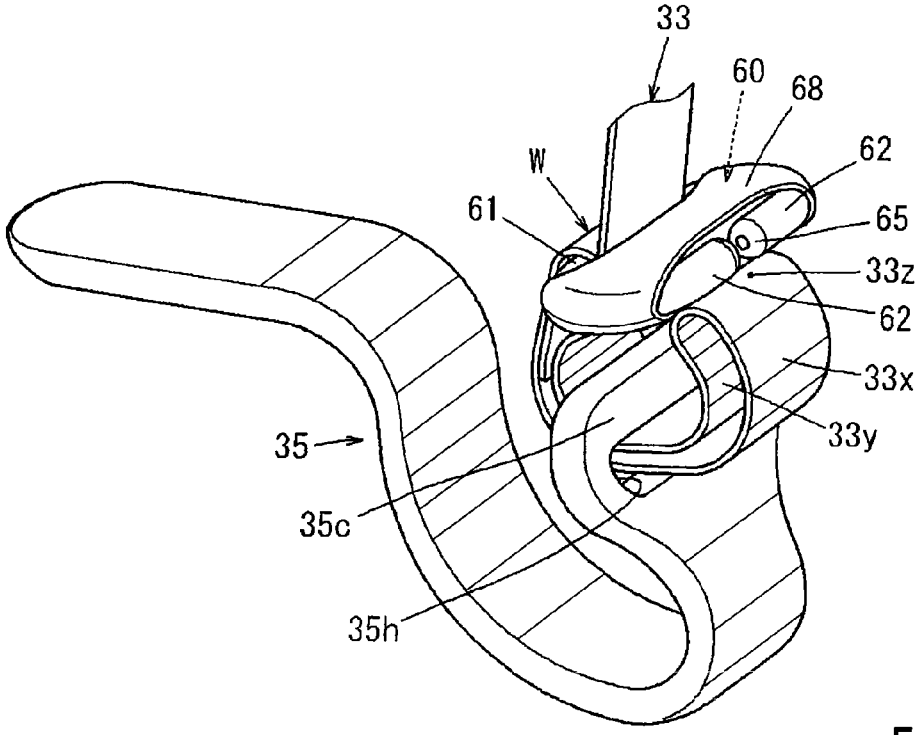
FIG. 15 is a perspective view illustrating the procedures for connecting the hook and the suspension belt.
Figure 16:
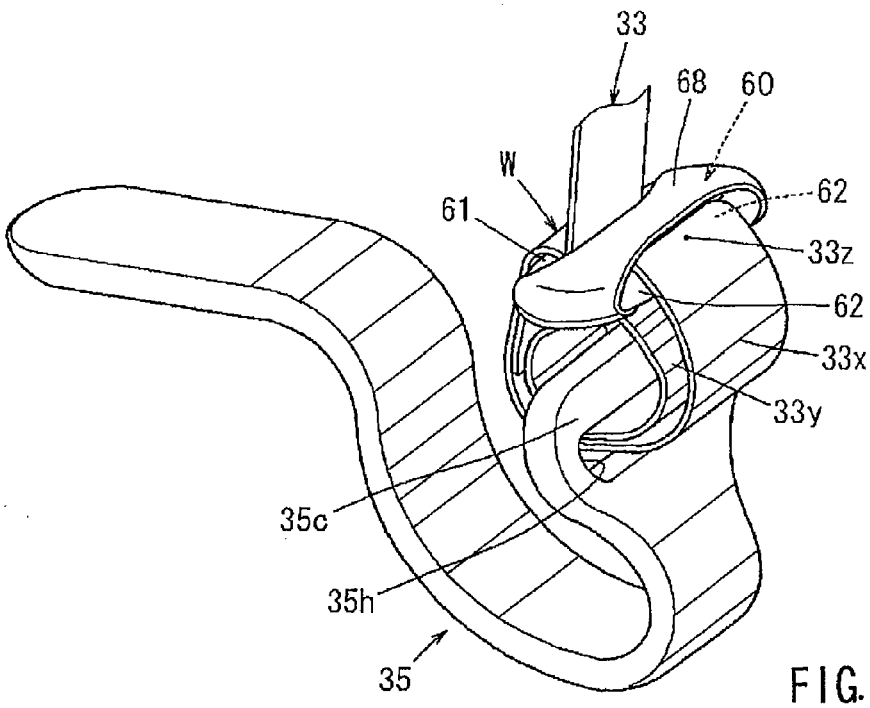
FIG. 16(A) is a perspective view illustrating the procedures for connecting the hook and the suspension belt.
FIG. 16(B) is a perspective view illustrating a condition in which a fold-back end of the suspension belt is engaged with the other side of the snap ring.
FIG. 16C is a perspective view illustrating a condition in which a fold-back end of the suspension belt is engaged with the other side of the snap ring.
Figure 16:
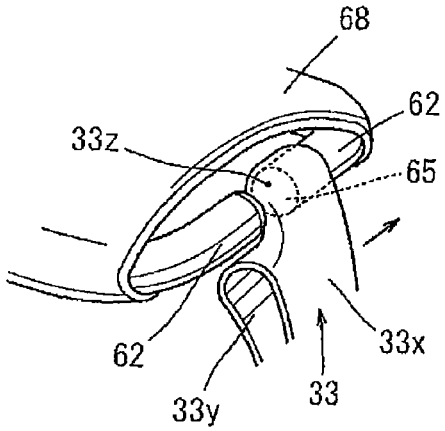
Figure 16:
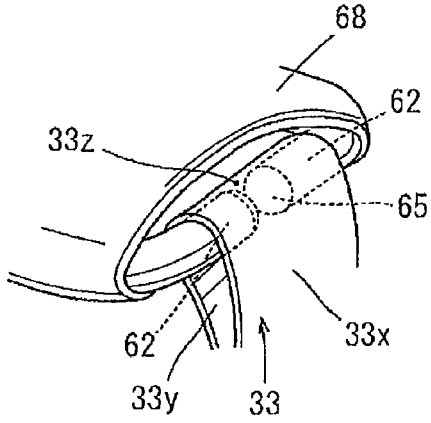
Figure 17:
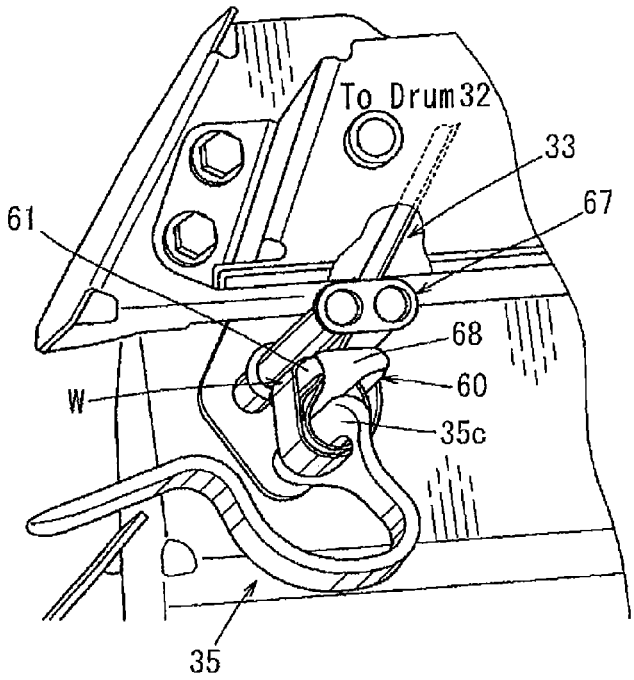
FIG. 17(A) is a perspective view illustrating a condition in which the hook is wound up to an upper limit position.
FIG. 17(B) is an enlarged view of a portion around a hook stopper portion.
Figure 17:
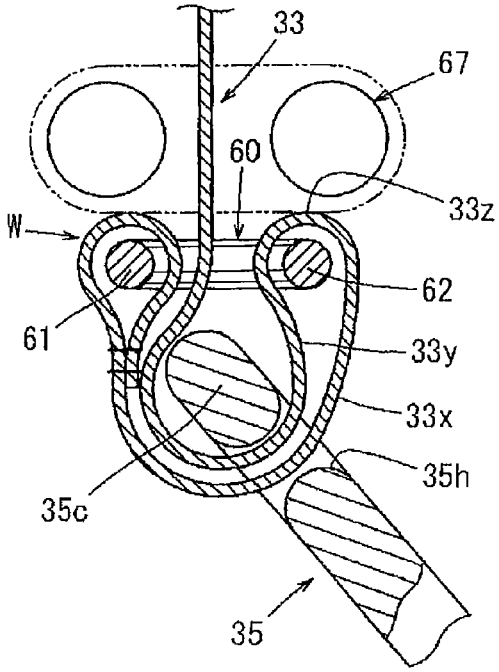
Figure 18:
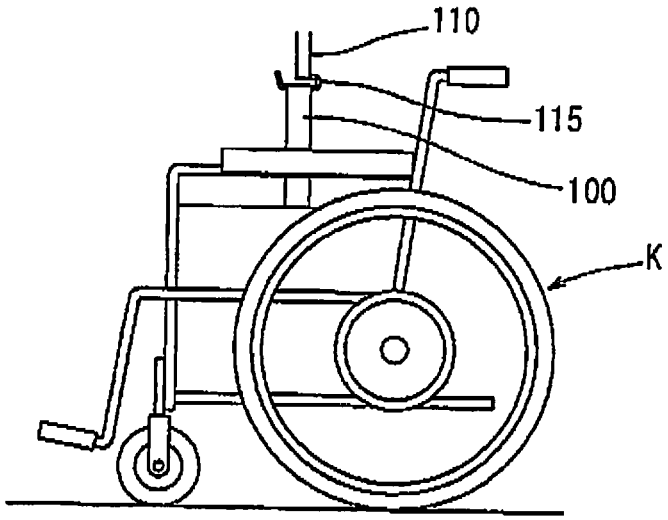
FIG. 18 (A) PRIOR ART
FIG. 18(A) is a side view of a conventional wind-up device.
FIG. 18(B) is a perspective view of a hook.
Figure 18:
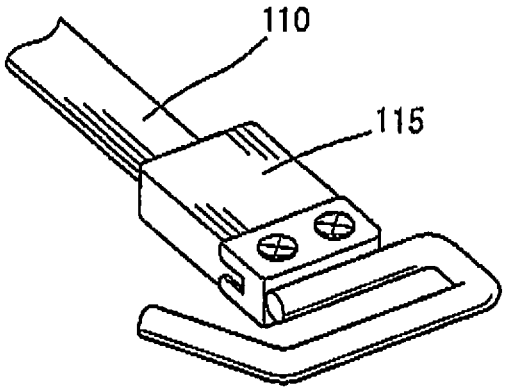
FIG. 18 (B) PRIOR ART

In the connection structure of the present embodiment, the tubular portion W of the suspension belt 33 is first engaged with one side portion 61 of the snap ring 60 using the gap 65 of the snap ring 60. Further, the distal end portion of the suspension belt 33 is passed to the inside of the snap ring 60. Next, as shown in FIG. 14, a portion (a distal end portion) of the suspension belt 33 in the vicinity of the tubular portion W is doubly folded back over a desired length. Subsequently, fold-back portions 33*x* and 33*y* (a two-ply portion) is passed through the belt hole 35*h* of the hook 35. Next, as shown in FIG. 15, the snap ring 60 is covered by an elastic tubular cover member 68 over a portion from one side portion 61 to both of the arcuate portions 63.

Further, the fold-back portions 33*x* and 33*y* of the suspension belt 33 can be passed through the belt hole 35*h* of the hook 35 after the snap ring 60 is covered by the cover member 68.

Next, as shown in FIGS. 16(B) and 16(C), a fold-back end 33*z* of the fold-back portions 33*x* and 33*y* (the two-ply portion) of the suspension belt 33 is engaged with the other side portion 62 of the snap ring 60 using the gap 65 of the snap ring 60. In this condition, a connecting operation of the hook 35 and the suspension belt 35 is completed. Further, for example, in FIGS. 13(A) and 13(B), the cover member 68 is omitted.

Thus, the tubular portion W formed in a distal end of the suspension belt 33 is connected to one side portion 61 of the snap ring 60. Conversely, the halfway portion of the suspension belt 33 is engaged with the other side portion 62 of the snap ring 60 from the outside. Further, a portion (the fold-back portion 33*x*) of the suspension belt 33 extending from one side portion 61 to the other side portion 61 of the snap ring 60 and a portion (the fold-back portion 33*y*) of the suspension belt positioned between the other side portion 62 of the snap ring 60 and the drum 32 are passed through the belt hole 35*h* of the hook 35 in a two-ply condition, and are engaged with the lateral shaft-shaped support 35*c* of the hook 35. Further, in this condition, the hook 35 can be disengaged from the suspension belt 33 by performing a reverse procedure of the procedure described above.

Thus, because the hook 35 and the suspension belt 33 are connected to each other via the snap ring 60, the suspension belt 33 can be easily disengaged from the hook 35 as compared with a construction in which the hook 35 and the suspension belt 33 are directly connected to each other. Accordingly, the hook 35 and the suspension belt 33 can be singly replaced with new ones.

Further, a two-ply portion (the fold-back portions 33*x* and 33*y*) of the suspension belt 33 can be engaged with the support 35*c* of the hook 35. Therefore, once a tensile force is applied to the suspension belt 33 to tighten the suspension belt 33 (the fold-back portions 33*x* and 33*y*) positioned between the hook 35 and the snap ring 60, the fold-back portion 33*x* and 33*y* of the suspension belt 33 cannot be easily loosened even when the tensile force is released. That is, the hook 35 and the snap ring 60 are bound by the suspension belt 33. Thus, the snap ring 60 can be prevented from hitting the hook 60 each time the suspension belt 33 is wound up. As a result, generation of noise can be suppressed. Further, the hook 60 and other components can be prevented form being damaged with time.

Further, when the tensile force is applied to the suspension belt 35, both of one side portion 61 and the other side portion 62 of the snap ring 60 are pulled toward the lateral shaft-shaped support 35*c* of the hook 35 by a uniform force (shown by arrows in FIG. 13(B). As a result, the snap ring 60 is attached to the support 35*c* of the hook 35 in a substantially horizontal posture. Thus, as shown in FIGS. 17(A) and 17(B), when the hook 35 is wound up to the upper limit position, so that the snap ring 60 contacts the hook stopper 67, one side portion 61 and the other side portion 62 of the snap ring 60 can contact the hook stopper 67 at the substantially same moment. Thus, the hook 35 can be prevented from precariously swinging.

Further, since the snap ring 60 is covered by the cover member 68, the snap ring 60 can be prevented from being damaged by contacting the hook stopper 67.

<Modified Forms>

Further, the present invention is not limited to the embodiment and can be modified without departing from the scope of the present invention. For example, in the connection structure of the hook 35 and the suspension belt 33 according to the present embodiment, the snap ring 60 in which a circumferential portion thereof is cut off to form the gap 65 therein is used. However, the gap 65 of the snap ring 60 can be omitted. In this case, the suspension belt 33 is sequentially inserted into the snap ring 60 and the belt hole 35*h* of the hook 35 from the distal end thereof.

Further, in the present embodiment, the snap ring 60 is covered by the cover member 68. However, the cover member 68 can be omitted provided that for example, the snap ring 60 and the hook 35 are coated with resin.

The embodiment can be expressed as follows.

A wind-up device in which a hook connected to a suspension belt is hooked on a hook receiving belt provided along a seating surface of a wheelchair and in which the wheelchair can be lifted up by winding up the suspension belt, wherein the hook has a belt hole through which the suspension belt is passed and has a support to which the suspension belt is attached being provided on the upper side of the belt hole, which support is positioned above the belt hole, wherein the suspension belt is attached to a drum capable of winding or unwinding the suspension belt, wherein a distal end portion of the suspension belt is secured to one side of a ring-shaped snap ring, further wherein a halfway portion of the suspension belt is engaged with the other side of the snap ring from an outside, which side is positioned opposite to one side portion across a center, and wherein a portion of the suspension belt extending from one side portion to the other side portion of the snap ring and a portion of the suspension belt positioned between the other side portion of the snap ring and the drum are passed through the belt hole of the hook in a two-ply condition, and are engaged with the support of the hook.

In the wind-up device, a circumferential portion of the snap ring may be cut off to form a gap therein. Further, the suspension belt can be guided to an inside of the snap ring from an outside of the snap ring using the gap.

The wind-up device may further include a cover member covering the snap ring.

The invention claimed is:

1. A rotation device comprising a cylindrical rotating body that is configured to be rotatable about an axis, a pair of brackets positioned substantially perpendicular to the axis of the cylindrical rotating body and respectively rotatably supporting axial ends of the cylindrical rotating body, a first motor attached to one of the brackets, a second motor attached to the other of the brackets, a pair of rotating body-side gears that are coaxially secured to both axial ends of the cylindrical rotating body, a first gear connected to the first motor and meshed with one of the rotating body-side gears, and a second gear connected to the second motor and meshed with the other of the rotating body-side gears, wherein the pair of brackets are oppositely positioned on both axial ends of the cylindrical rotating body, and the brackets are rotatable relative to each other about the axis of the cylindrical rotating body, and wherein the brackets have a guide mechanism formed therein that is configured to guide one of the brackets having the first motor, and the other of the brackets having the second motor, so as to allow the brackets to rotate about the axis of the cylindrical rotating body relative to each other.

2. The rotation device as defined in claim 1, wherein the pair of bracket is composed of a first bracket supporting one axial end of the cylindrical rotating body and a second bracket supporting the other axial end of the cylindrical rotating body, wherein the first motor and the first gear are attached to the first bracket, further wherein the second motor and the second gear are attached to the second bracket, and wherein the guide mechanism is positioned between the first bracket and the second bracket.

3. The rotation device ad defined in claim 1, wherein the pair of rotating body-side gears are respectively attached to one axial end side and the other axial end side of the cylindrical rotating body, and wherein the rotating body-side gear attached to one axial end side of the cylindrical rotating body is meshed with the first gear, further wherein the rotating body-side gear attached to the other axial end side of the cylindrical rotating body is meshed with the second gear.

4. The rotation device as defined in claim 1, wherein the guide mechanism has a pin, and an arcuate elongated hole that is capable of guiding the pin.

5. A wind-up device for lifting up a wheelchair, comprising:

a suspension belt, a hook connected to the suspension belt, a hook receiving belt provided along a seating surface of the wheelchair, a rotation device as a wind-up drive source, wherein the hook has a belt hole through which the suspension belt is passed and has a support to which the suspension belt is attached being provided on the upper side of the belt hole, which support is positioned above the belt hole, wherein the suspension belt is attached to a drum capable of winding or unwinding the suspension belt, wherein a distal end portion of the suspension belt is secured to one side of a ring-shaped snap ring, further wherein a halfway portion of the suspension belt is engaged with the other side of the snap ring from an outside, which side is positioned opposite to one side portion across a center, wherein a portion of the suspension belt extending from one side portion to the other side portion of the snap ring and a portion of the suspension belt positioned between the other side portion of the snap ring and the drum are passed through the belt hole of the hook in a two-ply condition, and are engaged with the support of the hook, wherein the rotation device comprises a cylindrical rotating body that is configured to be rotatable about an axis, a pair of brackets positioned substantially perpendicular to the axis of the cylindrical rotating body and respectively rotatably supporting axial ends of the cylindrical rotating body, a first motor attached to one of the brackets, a second motor attached to the other, a pair of rotating body-side gears that are coaxially secured to both axial ends of the cylindrical rotating body, a first gear connected to the first motor and meshed with one of the rotating body-side gears, and a second gear connected to the second motor and meshed with the other of the rotating body-side gears, wherein the pair of brackets are oppositely positioned on both axial ends of the cylindrical rotating body, and the brackets are rotatable relative to each other about the axis of the cylindrical rotating body, and wherein the brackets have a guide mechanism formed therein that is configured to guide one of the brackets having the first motor, and the other of the brackets having the second motor so as to allow the brackets to rotate about the axis of the cylindrical rotating body relative to each other.

6. The wind-up device as defined in claim 5, wherein a circumferential portion of the snap ring is cut off to form a gap therein, and wherein the suspension belt is guided to an inside of the snap ring from an outside of the snap ring using the gap.

7. The wind-up device as defined in claim 5 further comprising a cover member covering the snap ring.

* * * * *